United States Patent [19]

Norris et al.

[11] 4,246,750

[45] Jan. 27, 1981

[54] SELF-TWIST YARN AND METHOD OF MAKING SAME

[75] Inventors: Alan H. Norris; Phillip W. Chambley, both of Rome, Ga.

[73] Assignee: WWG Industries, Inc., Rome, Ga.

[21] Appl. No.: 60,095

[22] Filed: Jul. 24, 1979

Related U.S. Application Data

[63] Continuation of Ser. No. 906,483, May 17, 1978, abandoned.

[51] Int. Cl.[3] ..... D02G 3/28; D01H 7/92; D02G 1/02

[52] U.S. Cl. ..... 57/293; 57/204; 57/205; 57/285; 57/290

[58] Field of Search ..... 57/293, 294, 285, 204, 57/205, 290

[56] References Cited

U.S. PATENT DOCUMENTS

| | | | |
|---|---|---|---|
| 3,443,370 | 5/1969 | Walls | 57/204 X |
| 3,775,955 | 12/1973 | Shah | 57/293 |
| 4,074,511 | 2/1978 | Chambley et al. | 57/293 |

*Primary Examiner*—John Petrakes

[57] ABSTRACT

Groups of singles yarns are false-twisted, brought together node locked and plied to form plied strands. Additional torque in the plying direction is applied beyond the equilibrium point to add twist to the plied strands. Jet devices using air or steam can be used to apply the additional torque.

3 Claims, 5 Drawing Figures

SELF-TWIST YARN AND METHOD OF MAKING SAME

Figure 1:
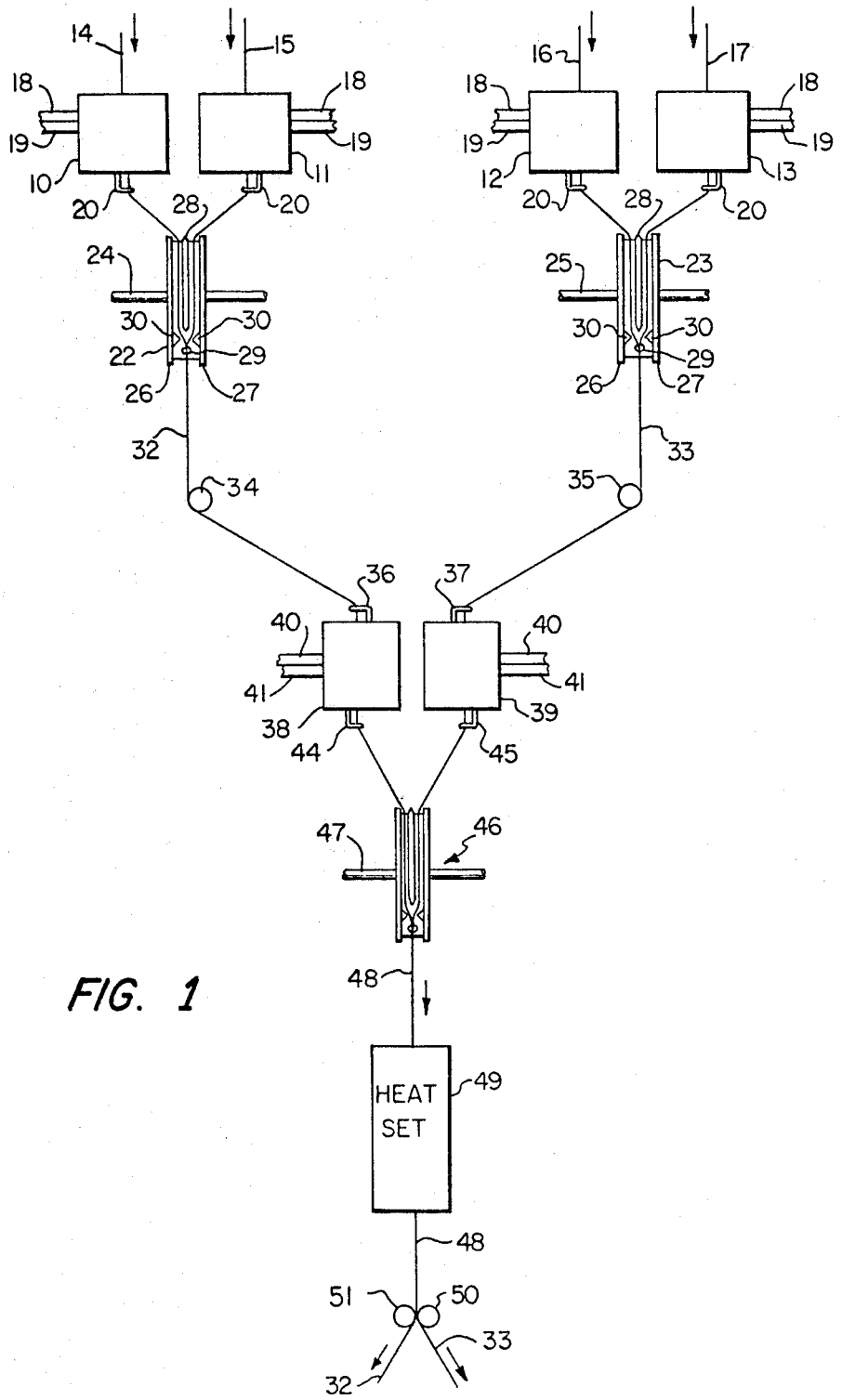
Figure 2:
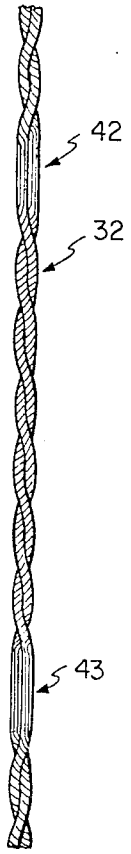

This is a continuation of application Ser. No. 906,483, filed May 17, 1978 and now abandoned.

This invention relates to an improved twisted plied yarn and to methods and apparatus for producing same.

BACKGROUND OF THE INVENTION

The concept of producing plied yarns using the false-twist, self-twist phenomenon is now rather well known in the art. Documents in which the general principles of false-twisting and self-twisting are described include the following:

| | |
|---|---|
| "Self-Twist Yarn," D. E. Henshaw, Merrow Publishing Co., Ltd., Watford, Herts, England, 1971 | |
| RE 27,717 | Breen et al |
| 3,225,533 | Henshaw |
| 3,306,023 | Henshaw et al |
| 3,353,344 | Clendening, Jr. |
| 3,434,275 | Backer et al |
| 3,443,370 | Walls |
| 3,507,108 | Yoshimura et al |
| 3,717,988 | Walls |
| 3,775,955 | Shah |
| 3,940,917 | Strachan |

For purposes of convenience, some general comments concerning producing plied yarn by these techniques will be described. It is possible to form a plied yarn by false-twisting two or more singles yarn strands, attaching the strands to each other and then permitting the strands to wrap about each other using the release of forces stored by the false-twisting to accomplishing the plying, hence the term "self-twist". The false-twisting itself, in simplified form, involves holding spaced points of a yarn strand and twisting the strand in one direction at a point intermediate the held points, e.g., the center. This produces twists on one side of the center in one direction and on the other side of the center in the opposite direction. The center of the twisted strand constitutes a point of twist reversal and is called a "node". Clearly, forces are stored in the strand in the twisting step. When two strands similarly false-twisted are brought together in side-by-side juxtaposition with their ends held and permitted to act against or with each other by releasing a central node, the stored forces cause the strands to ply, i.e., to wrap around each other spontaneously. The process is enhanced and the product made more stable if the nodes of the two strands are aligned and are joined or locked together before release and plying.

As will be recognized, the torque or twist force exerted by each strand is roughly proportional to the amount of twist therein and that such force decreases as the strands ply. The plying step itself therefore continues until the stored twist forces in each strand decrease to a point at which the remaining twist forces are exactly counterbalanced by the resistance to further twisting in the plied yarn. Thus, if one begins with individual strands and then false twists the strands and plies them, each strand will end up, in the plied yarn, with some degree of false-twist which can be thought of as some remaining stored potential energy, the force exerted thereby being too small to cause further ply twisting against opposing forces in the plied yarn. In a stable plied yarn formed in this fashion, the amount of singles twist always is greater than the amount of ply twist.

Generally speaking, this remaining stored force or energy may not be particularly disadvantageous, depending upon the type of fabric to be produced from the plied yarn. However, when the yarn is to be used to produce certain products such as pile or tufted carpet, the relationship of the remaining twist in the singles yarn becomes highly significant because of the appearance of the product produced therefrom.

Consider, for example, a plied yarn formed from two singles yarns in which the value of singles twist is equal to 1.4 times the value of ply twist ($S=1.4\ P$). In this circumstance it has been found that the fibers in the individual strands are substantially parallel with the axis of the plied yarn. A tufted carpet made from yarn of this description exhibits two significant disadvantages, one of these being the fact that relatively minor variations in the manufacturing process, such as small variations in twist between spindles, causes large changes in the light reflectance characteristics of the carpet tufts, and the carpet can have a highly noticeable streaky appearance which is unacceptable. The second major problem is that with $S=1.4\ P$ or more, the individual yarn strands tend to retain their identity as individual strands, even though plied, and tend to split at the tuft tips into separate singles strands which are visible and which give the carpet surface an undesirable "stringy" appearance.

It is also known, as shown in aforementioned U.S. Pat. No. 3,443,370, Walls, to produce a yarn by false-twisting a number of strands greater than two or more assembled threads or yarns, and plying steps with the previously plied yarns to form what can be termed a braid.

However, in forming a braid from previously plied strands, the various forces interact in each plying process in such a way that it is difficult to predict the degree of twist which will exist after all of the steps, and it is therefore a rather complicated process to arrive at an end product which has twist relationships which meet desired specifications.

BRIEF DESCRIPTION OF THE INVENTION

It has been found, however, that by inserting specified degrees of twist in singles yarns, locking the nodes of the yarns, permitting them to ply together to form strands, false twisting selected ones of the strands, locking nodes of the strands and permitting the strands to ply together into a braid, a product having predictable and consistent twist relationships can be obtained.

It has further been found that locking a plurality of plied false-twisted strands together at the nodes permits a dramatic increase in the number of strands which can be heat set in a given interval with little increase in energy input, thereby significantly increasing the production rate of such yarns and reducing the cost per unit length of the heat-setting operation.

Additionally, it has been found that heat setting braided or joined false-twisted plied strands results in a product which can be used as it is in producing, for example, tufted carpets; or which can be separated into plied strands which have predictable desired characteristics and can individually be used in carpet manufacture.

Briefly described, the invention includes a method of forming stable twisted yarn products comprising the steps of providing a plurality of singles yarns in a plurality of groups and maintaining the yarns in each group separated from each other, imparting false twist to at least one of the singles yarns in each group to form in the yarn a sequence of twist regions having longitudinally spaced regions of alternating S and Z twist separated by nodes of twist reversal, placing the yarns in each group in closely spaced relationship with each other, joining the yarns in each group to each other at the locations of the nodes, permitting the yarns in each group to self-twist to form a plurality of plied strands wherein twist torques are at substantial equilibrium, imparting additional twist to each of the plied strands to form therein a sequence of twist regions of alternating S and Z twist separated by the joined nodes, placing the strands in closely spaced relationship with each other with the nodes thereof longitudinally aligned, joining the plied strands to each other at the node locations, and heating the joined plied strands to a temperature sufficient to heat-set the twist characteristics thereof.

In order that the manner in which the various objects of the invention are attained can be understood in detail, particularly advantageous embodiments thereof will be described with reference to the accompanying drawings, which form a part of this specification, and wherein:

FIG. 1 is a schematic diagram showing an apparatus for accomplishing the invention; and FIGS. 2–5 are illustrations schematically showing yarns formed in accordance with the invention for explanatory purposes.

As shown in FIG. 1, an apparatus for forming yarns in accordance with the invention includes a plurality of twist jets 10, 11, 12 and 13 which have central openings through which yarns 14, 15, 16 and 17 can pass. Yarns 14–17 are singles yarns which have been formed in a well-known manner and can be, for example, continuous filament or bulked continuous filament yarn, preferably of a synthetic type. The twist jets themselves include pairs of inlets 18 and 19 into which air under pressure can be selectively introduced. Inlets 18 and 19 lead into passages within twist jets 10–13 which tangentially intersect the central passages through which yarns 14–17 pass. Thus, if air under pressure is introduced through inlet 18 of each of the jets, the yarns passing through the jets will be subjected to vortexes of air in each of the central passages and will be caused to twist in one direction. If, subsequently, air under pressure is introduced into inlets 19, the yarns will be twisted in the opposite direction. It will be recognized that air would not be introduced into inlets 18 and 19 simultaneously. Twist jets usable as jets 10–13 are more fully disclosed in U.S. Patent Application Ser. No. 755,671, filed Dec. 30, 1976, now U.S. Pat. No. 4,074,511, and, since they do not specifically form a part of the present invention, they will not be further described herein.

At the outlet end of each of twist jets 10–13 is a simple wire guide 20 which performs the function of acting as a twist trap in that the twist imparted to the yarn which has passed the wire guide does not migrate upwardly beyond the guide, and the air flow can thus be reversed, forming a node of twist reversal. The wire guides also permit the yarn to change direction, as illustrated, without altering their central path through the twist jets.

Each of yarns 14–17 is conducted onto a yarn guide wheel, guide wheel 22 receiving yarns 14 and 15 and guide wheel 23 receiving yarns 16 and 17. Wire guides would also normally be provided at the inlet position of the yarn onto the wheel so that the direction can again be changed. Guide wheels 22 and 23 are supported on axles 24 and 25, respectively, which are driven by motors, not shown, at a predetermined speed which is consistent with the running speed of yarns passing through the system. The guide wheels both includes flanges 26 and 27 at their axial limits and a central separatory flange 28 which maintains the yarns in spaced relationship through a portion of travel around the yarn wheel. Peripheral guide surfaces are thus defined between the three flanges on which the yarns can lie. It will be observed that the separatory flanges 28 are interrupted at at least one point on the yarn wheel, at which location there is provided a joining means 29 which is capable of locking the yarns together at one point. Adjacent the joining means location are inwardly extending guide members 30 which cause the yarns to be brought together so that they can be joined by devices 29.

Yarn wheels of this type are also discussed in detail in the previously mentioned Application Ser. No. 755,671, and the subject matter of that application is incorporated by reference herein. As disclosed therein, the joining devices 29 can be disc-like members having a surface exposed to the yarn capable of engaging and entangling fibers of the yarns with each other so that the singles yarns are joined together. The wheel is rotated, as previously mentioned, at a speed correlated with the running speed of the yarn so that there is minimal or no relative movement between the yarn and the guide surfaces of the guide wheel. Thus, the yarn is laid on the wheel and travels with it and the yarns are brought together and joined at the node locations. If one joining device is provided, it will be apparent that the space between nodes of the yarn is equal to the circumferential dimension of the yarn wheel.

As the singles yarns leave the yarn wheel, they are thus joined together at their nodes and can self-twist or ply together, forming plied yarns 32 and 33. It will be recognized that in order for the yarns to ply, it is necessary that jets 10 and 11 be synchronized so that twist in the same direction is imparted to yarns 14 and 15 at the same time. Similarly, jets 12 and 13 are synchronized to produce twist in the same direction at the same time. As will be described hereinafter, the relationship between the twist imparted by jets 10 and 11 and the twist imparted by jets 12 and 13 can be similarly synchronized or can be intentionally unsynchronized, depending upon the ultimate effect desired.

Yarns 32 and 33 pass around idler rollers 34 and 35 and are directed through wire guides 36 and 37 to further jet twist devices 38 and 39. Jet twist devices 38 and 39 are substantially identical to devices 10–13 and include inlets 40 and 41 through which air under pressure can selectively be applied. Thus, twist is again imparted, but this time it is imparted to the plied yarns. At this point, it may be helpful to refer to FIG. 2 which shows, in a schematic form, a false-twisted and plied yarn such as yarn 32. As seen therein, the section illustrated includes two nodes of twist reversal which will be assumed to be joined by the technique described above or by any other suitable technique. Between the nodes 42 and 43, it will be recognized that there is a section of S-plied yarn formed from two Z-twisted singles strands, the Z twist having been imparted by jets 10 and 11 and the S ply having been formed as the joined yarns leave yarn wheel 22. Then, in jet 38, the yarn 32 is further twisted, the air supply to jet 38 being synchronized such that the yarn is twisted in the same direction as before.

The same can be said of yarn 33 which is further twisted by jet devices 39.

At the outlet end of twist devices 38 and 39, the yarn passes through wire guides 44 and 45 onto a yarn wheel 46 which is carried on an axle 47. Yarn wheel 46 can be identical to yarn wheels 22 and 23 and will therefore not be described again. Strands 32 and 33 are joined together on yarn wheel 46, producing a composite strand 48 which is conducted through a heat-setting device 49 in which the twist characteristics imparted to the various components are set. The heat-set device can be any conventional heat-setting apparatus utilizing steam, infrared energy, or other forms of elevating the yarn to the necessary level to heat-set the characteristics thereof. Generally speaking, with synthetic yarns, it is necessary to elevate the temperature of the yarns to the glass transition temperature, or second order transition temperature, at which the stresses in the yarns are relieved.

The heat-set composite yarn 48*a* then emerges from the heat-setting device and can optionally be caused to pass between rollers 50 and 51, forming a nip therebetween for conveyance and control purposes, and the yarns can then be separated into the components 32 and 33 for subsequent storage and/or use. Alternatively, the composite yarn 48 can be employed without further separation or treatment and can be, for example, tufted into a carpet.

Figure 3:
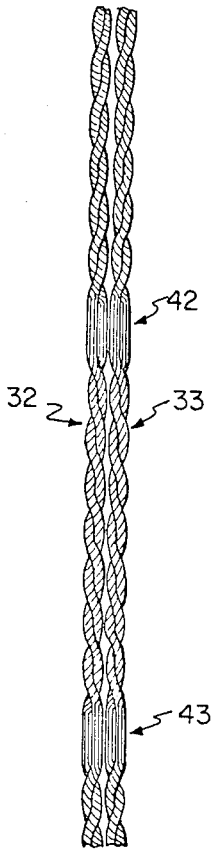
Figure 4:
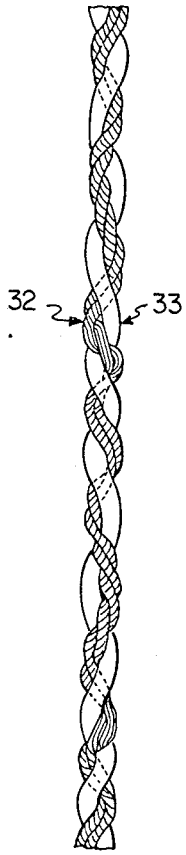
Figure 5:
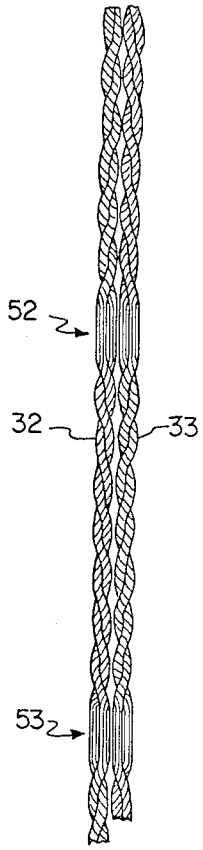

The characteristics of the composite yarn will be further described in connection with FIGS. 3–5. The characteristics of the end product are directly related to the twist directions imparted by the various twist jet devices. If the twist imparted by devices 10 and 11 is the same as, and substantially synchronized with, the direction of twist imparted by devices 12 and 13, the resulting plied strands 32 and 33 will have components of ply twist in the same directions. Also, the nodes thereof will be substantially aligned. Then, twist jet devices 38 and 39 can be caused to similarly produce twist in the same direction, adding twist to the plied yarns produced upstream. Yarn wheel 46 then joins the plied yarns together at the nodes, with increased twist therebetween, as illustrated in FIG. 3. As shown therein, strands 32 and 33 both have S ply twist between nodes 42 and 43, but with a higher degree of twist per inch, the plied strands being joined together at the same nodes at which the singles strands were joined. If this yarn is then released and permitted to ply after node locking, the plied strands will again ply or "cable" around each other, forming a yarn such as that illustrated in FIG. 4. As will be seen therein, for purposes of distinction, yarn 32 is drawn with the singles twist being shown and yarn 33 is drawn as a "clear" strand. However, it will be observed that this is only to make the drawing more clear, and that yarn 33 will appear to be substantially the same as yarn 32 in an actual product. Thus, the ply-twisted strands will self-twist about each other in a manner similar to singles twisted strands, forming a cable to be heat-set in heat-set unit 49.

Alternatively, if devices 12 and 13 are caused to be synchronized with twist devices 10 and 11, but phased such that the opposite directions of twist are formed thereby, the nodes of the yarns as they reach yarn wheel 46 will still be aligned but the direction of ply twist will be opposite. This can, of course, be accomplished also by lengthening the path of travel between yarn wheel 23 and yarn wheel 46 by the amount of one node length, or one spacing between nodes, to introduce the phase difference. Then, if the nodes are locked on wheel 46, the resulting product will appear as shown schematically in FIG. 5 wherein yarn 32 between nodes 52 and 53 exhibits an S ply twist with Z singles twist while the section of yarn 33 between those nodes exhibits a Z ply twist and S singles twist. Thus, upon node locking and release, these plied strands will not cable but will remain in the condition shown in FIG. 5. They can then be heat-set as previously described, and separated into individual plied strands for later use.

Either of these techniques can be employed to adjust the degree of singles twist which, when heat-set, remains in the plied yarn strands and, if cabled, in the cabled yarn.

In a yarn twist specification for carpet yarns, it is conventional to describe the twist in the form "4.2/3.5". This means, in an S ply, that 4.2 Z turns were put into the singles yarns and 3.45 S turns were later put in the ply. The convention thus refers to the twist inserted, and not to the actual twist in the yarn. When forming a single plied strand from two singles twist yarns, it is possible to make the singles twist in the final product what is required, but in doing so there is no control over the level of ply twist where the self-twist yarn is simply permitted to reach a simple torque balance between the single and ply twist torques. However, it is possible to make the singles twist to the required specification by adjustment of the singles twisting means.

If the composite two-ply self-twist yarn is regarded as a strand which contains some proportion of the required ply twist and if the twisting procedure is then repeated, i.e., more ply twist is added, and then the yarn is combined with a similarly formed yarn, there is now control over the singles twist and also the ply twist, but not in the cable twist.

Thus, to make the yarn to specification 4.2/3.5, the first step is to insert 4.2 turns of Z twist into the singles yarns and allow the yarns to ply. A typical value, for example, of the plied yarn would then be 4.2/2.0.

The second step is then to insert in a second stage more S turns into the plied yarn and self-twist with a similarly plied yarn. Using the same specification of 4.2/3.5, the yarn would then exhibit 4.2/2.0 plus the added turns plus the cable turns/some cable twist which could be, for example, 0.6.

The resulting yarn would be a four strand yarn of two two-ply yarns plied around each other. The two-ply yarn specification can be made to be correct if the added ply twist is chosen correctly, allowing for some loss in the cable twisting stage. It will be noted that the cable twist will be quite low. The additional ply turns in the second stage of the example amounts to only 2.1 S turn and this would produce a relatively small torque in balance resulting in the cable turns above of about 0.6 Z.

If the resulting yarn is then heat-set, the twist present in the yarn would be stabilized. The yarn can then be split back into two two-ply yarns which would have been heat-set at the correct twist specification. Thus, the resulting yarn can be described as 4.0/3.5/0.6, with the single and ply twists being correct.

In each of the examples given above, the numbers refer to turns per inch (tpi), in conformance with normal nomenclature. It will be observed that the method provides a substantial advantage since it reduces the effective cost of continuous heat-setting equipment per running yarn length by half for a two-ply cable. It will also be recognized that the apparatus shown in FIG. 1 can be modified to include additional pairs of twist jets occupying the positions of jets 10–13, and additional yarn wheels so that three or more plied yarns occupying the positions of yarns 32 and 33 can be produced. These can then be cabled together in subsequent steps, a third yarn being cabled together without additional twisting on wheel 46. The apparatus could, of course, simply be multiplied by two, using two wheels 46 and a further stage of twisting and node joining.

If the yarn is to be separated back from the cabled condition to the ply condition before use, then several plies per cable would be advantageous.

If it is not desired to have a cabled yarn at any stage, the technique described in connection with FIG. 5 can be employed wherein opposite twist sections are aligned and joined, the result being substantially the same because the added ply twist is still maintained in the joined "cable", even though the cable is not self-twisted in the manner shown in FIG. 4. The yarns can then be more easily separated.

While certain advantageous embodiments have been chosen to illustrate the invention, it will be understood by those skilled in the art that various changes and modifications can be made therein without departing from the scope of the invention as defined in the appended claims.

What is claimed is:

1. A method of forming stable twisted yarn products comprising the steps of providing a plurality of singles yarns in a plurality of groups and maintaining the yarns in each group separated from each other;

imparting false twist to at least one of the singles yarns in each group to form in said yarn a sequence of twist regions having longitudinally spaced regions of alternating S and Z twist separated by nodes of twist reversal;

placing the singles yarns in each group in closely spaced relationship with each other with regions of the same direction of twist disposed beside each other;

permitting at least two of the singles yarns in each group to self-twist to form a plurality of plied strands and imparting additional twist to at least two of said plied strands to form therein a sequence of twist regions of alternating S and Z ply twist separated by the nodes;

placing said plied strands in closely spaced relationship with each other with their regions of opposite ply twist being disposed beside each other and joining the plied strands to each other between regions of opposite twist; and heating the joined plied strands to a temperature sufficient to heat-set the twist characteristics thereof.

2. A method according to claim 1 which includes, after heating, the steps of cooling the heat-set strands, and separating the strands from each other.

3. A method of forming stable twisted yarn products comprising the steps of providing a plurality of singles yarns in a plurality of groups and maintaining the yarns in each group separated from each other;

imparting false twist to at least one of the singles yarns in each group to form in said yarn a sequence of twist regions having longitudinally spaced regions of alternating S and Z twist separated by nodes of twist reversal;

placing the singles yarns in each group in closely spaced relationship with each other with regions of the same direction of twist disposed beside each other; permitting at least two of the singles yarns in each group to self-twist to form a plurality of plied strands and imparting additional twist to at least two of said plied strands to form therein a sequence of twist regions of alternating S and Z ply twist separated by the nodes;

placing the plied strands in closely spaced relationship with each other with their regions of like ply twist being disposed beside each other;

permitting the plied strands to self-twist with each other to form a multiyarn cable in which each of the plied strands has a greater twist than it had prior to the insertion of additional twist therein;

heating the plied strands to a temperature sufficient to heat-set the twist characteristics thereof;

cooling the heat-set cable; and separating the plied strands from each other, each of said plied strands after said separating step having a greater twist than it had prior to the insertion of additional twist therein.

* * * * *